United States Patent [19]

Nakayama et al.

[11] Patent Number: 5,065,588

[45] Date of Patent: Nov. 19, 1991

[54] AIR-CONDITIONER SYSTEM

[75] Inventors: Susumu Nakayama, Shizuoka; Kensaku Oguni, Shimizu; Hiromu Yasuda, Shizuoka; Rumi Minakata, Shizuoka; Kazumoto Urata, Shizuoka; Masatoshi Muramatsu, Shimizu; Kenji Tokusa, Shizuoka; Takao Senshu, Shizuoka; Hirokiyo Terada, Shizuoka; Fumihiko Kitani, Shimizu, all of Japan

[73] Assignee: Hitachi, Ltd., Tokyo, Japan

[21] Appl. No.: 564,608

[22] Filed: Aug. 9, 1990

[30] Foreign Application Priority Data

Aug. 17, 1989 [JP] Japan ..... 1-211937
Oct. 25, 1989 [JP] Japan ..... 1-275869

[51] Int. Cl.[5] ..... F25B 13/00
[52] U.S. Cl. ..... 62/160; 62/324.1
[58] Field of Search ..... 62/324.1, 160

[56] References Cited

U.S. PATENT DOCUMENTS 4,592,206 6/1986 Yamazaki et al. ..... 62/160
4,711,094 12/1987 Ares et al. ..... 62/324.1 X
4,771,610 9/1988 Nakashima et al. ..... 62/324.1 X
4,862,705 9/1989 Nakamura et al. ..... 62/324.1
4,878,357 11/1989 Sekigami et al. ..... 62/160

*Primary Examiner*—William E. Tapolcai

*Attorney, Agent, or Firm*—Antonelli, Terry, Stout & Kraus

[57] ABSTRACT

An air-conditioner system having a compressor, a plurality of heat exchangers for heating or cooling the air in a room, a radiator for transferring heat energy of refrigerant outside of the room, a plurality of orifices, a manifold with a main port and a plurality of sub-ports, flow direction control multi-port valves directing the flow of the refrigerant from the compressor to the main port and not from the main port to the compressor when at least one of the heat-exchangers is heating the room. The refrigerant does not flow from the compressor to the radiator when at least one of the heat exchangers is heating and none of the heat exchangers is cooling. Also, it does not flow from the compressor to the main port but flows instead from the compressor to the radiator and from the main port to the compressor when none of the heat exchangers is heating and at least one of the heat exchangers is cooling. The system also employs a plurality of valve pairs each of which having a first valve and second valve such that the first valve opens (closes) when the second valve closes (opens). The first valves are arranged for providing flow of refrigerant to the inlet of the compressor from the heat exchangers and the second valves provide flow of refrigerant from the outlet port of the compressor to the respective heat exchanger first ports via the sub-ports of the manifold.

5 Claims, 8 Drawing Sheets

AIR-CONDITIONER SYSTEM

BACKGROUND OF THE INVENTION

1. Field of the Invention

The present invention relates to an air-conditioner system including a plurality of air-conditioners each of which is a heat exchanger for either heating or cooling air in a room.

2. Description of Related Art

A prior-art air-conditioner system including a plurality of air-conditioners is proposed in, for example, Japanese Patent Unexamined Publication No. 49-127254, wherein a plurality of four-ports-connection-valves (i.e., valves having four ports) are respectively connected to the air-conditioners and a plurality of outdoor-radiators are respectively connected to the air-conditioners, so that each of the air-conditioners can selectively either heat or cool the air in the room. In the prior-art air-conditioner system, when at least one of the air-conditioners is stopped, the high-pressure refrigerant is stationarily held between an output of a compressor and the stopped air-conditioner, and the high-pressure refrigerant liquefies in accordance with a decrease in temperature thereof. Therefore, there is a possibility of a large amount of the liquefied refrigerant being held stationary between the output of the compressor and the stopped air-conditioner and the amount of the refrigerant capable of flowing in the air-conditioner system becoming undesirably decreased.

SUMMARY OF THE INVENTION

The object of the present invention is to provide an air-conditioner system in which each of a plurality of air-conditioners thereof is a heat exchanger for either heating or cooling air in an air-conditioned room as occasion demands and the amount of high-pressure refrigerant held stationarily between an output of a compressor and the air-conditioner can be decreased in comparison with the prior art so that the amount of the stationary high-pressure liquefied refrigerant is decreased.

An air-conditioner system according to the present invention comprises:

compressor means including an inlet port through which refrigerant flows into the compressor means and an outlet port through which the refrigerant compressed by the compressor means flows out of the compressor means;

a plurality of heat-exchanger means each of which is either heating or cooling air in an air-conditioned room as occasion demands and includes a heat exchanger first port and a heat exchanger second port between which the refrigerant flows in the heat exchanger means to transfer heat energy from the refrigerant to the air in the air-conditioned room;

radiator means which includes a radiator first port and a radiator second port between which the refrigerant flows in the radiator mans to transfer heat energy from the refrigerant to the outside of the air-conditioned room; and a plurality of orifice means each of which includes an orifice first port and an orifice second port between which the compressed refrigerant expands adiabatically, and each of the orifice means being connected to the heat exchanger second port, of a respective one of the plurality of heat exchanger means, through the orifice first port and being connected to the radiator second port through the orifice second port, wherein the air-conditioner system further comprises:

manifold means including main port means and a plurality of sub-port means connected to the heat exchanger first ports, respectively, the heat exchanger first ports communicating with the main port means through the respective sub-port means in the manifold means;

flow direction control means arranged between the compressor means and the main port means and between the outlet port and the radiator first port wherein the flow direction control means controls the directions of flow so that the refrigerant flows from the outlet port to the main port means and not from the main port means to the inlet port when at least one of the heat exchanger means heats the air in the air-conditioned room, the flow direction control means does not permit refrigerant flow from the outlet port to the radiator first port when at least one of the heat exchanger means heats the air in the air-conditioned room and none of the heat exchanger means cools the air in the air-conditioned room, and the flow direction control means doe snot permit refrigerant flow from the outlet port to the main port means but allows refrigerant flow from the outlet port to the radiator first port and from the main port means to the inlet port when none of the heat exchanger means is heating the air in the air-conditioned room and at least one of the heat exchanger means is cooling the air in the air-conditioned room;

a plurality of valve pairs, each of the valve pairs including first valve means and second valve means, the heat exchanger first ports being connected to the respective sub-port means through the respective first valve means, the heat exchanger first ports being connected to the inlet port through the respective first valve means, the heat exchange first ports being connected to the inlet part through the respective second valve means, wherein in each of the valve pairs the first valve means becomes opened to permit the flow of the refrigerant between the heat exchanger first port and the sub-port means and when the second valve means closes refrigerant flow is prevented between the heat exchanger first port and the inlet port, however, the second valve means becomes opened to permit the flow of refrigerant between the heat exchanger first port and the inlet port and when the first valve means closes the flow of refrigerant is prevented between the heat exchanger first port and the sub-port, and wherein the first valve means which is connected to the heat exchanger means heating the air in the air conditioned room is opened and the first valve means which is connected to the heat exchanger means cooling the air in the air conditioned room is closed when at least one of the heat exchanger means heats the air in the air conditioned room, the first valve means which is connected to the heat exchanger means cooling the air in the air-conditioned room is opened when none of the heat exchanger means heats the air in the air conditioned room and at least one of the heat exchanger means cools the air in the air condition room; and third valve means being arranged between the inlet port and the radiator first port, the third valve means opening to permit flow of the refrigerant from the radiator first port to the inlet port when at least one of the heat exchanger means heats the air in the air-conditioned room and none of the heat exchanger means cools the air in the air-conditioned room, and the third valve means closing so as to prevent the flow of refrigerant from the radiator first port to the inlet port when the flow direction control means controls the flow of refrigerant so that it is from the outlet port to the radiator first port.

In the air-conditioner system according to the present invention, the flow direction control means provides the flow of refrigerant from the outlet port to the main port means and at least one of the first valve means is opened to permit the flow of refrigerant from the outlet port to the heat exchanger when at lest one of the heat exchanger means heats the air in the air-conditioned room. The flow direction control means also provides the flow of refrigerant from the main port means to the inlet port and at least one of the first valve means is opened to permit the flow of refrigerant from the heat exchanger to the inlet port when none of the heat exchanger means heats the air in the air-conditioned room and at least one of the heat exchanger means cools the air in the air-conditioned room. That is, the refrigerant always flows between the main port means and the compressor means when at least one of the heat exchanger means heats the air in the air-conditioned room, such as, when the air-conditioner system is operated, so that the high-pressure refrigerant is prevented from being held stationary between the compressor means and the manifold mans and the high-pressure refrigerant is prevented from becoming liquefied between the compressor means and the manifold mans upon a decrease in temperature, such as, would be effected by the high-pressure refrigerant that is held stationary. Therefore, the amount of the refrigerant capable of flowing in the air-conditioner system is prevented from decreasing to an undesirable amount.

DETAILED DESCRIPTION OF PREFERRED EMBODIMENTS

Figure 1:
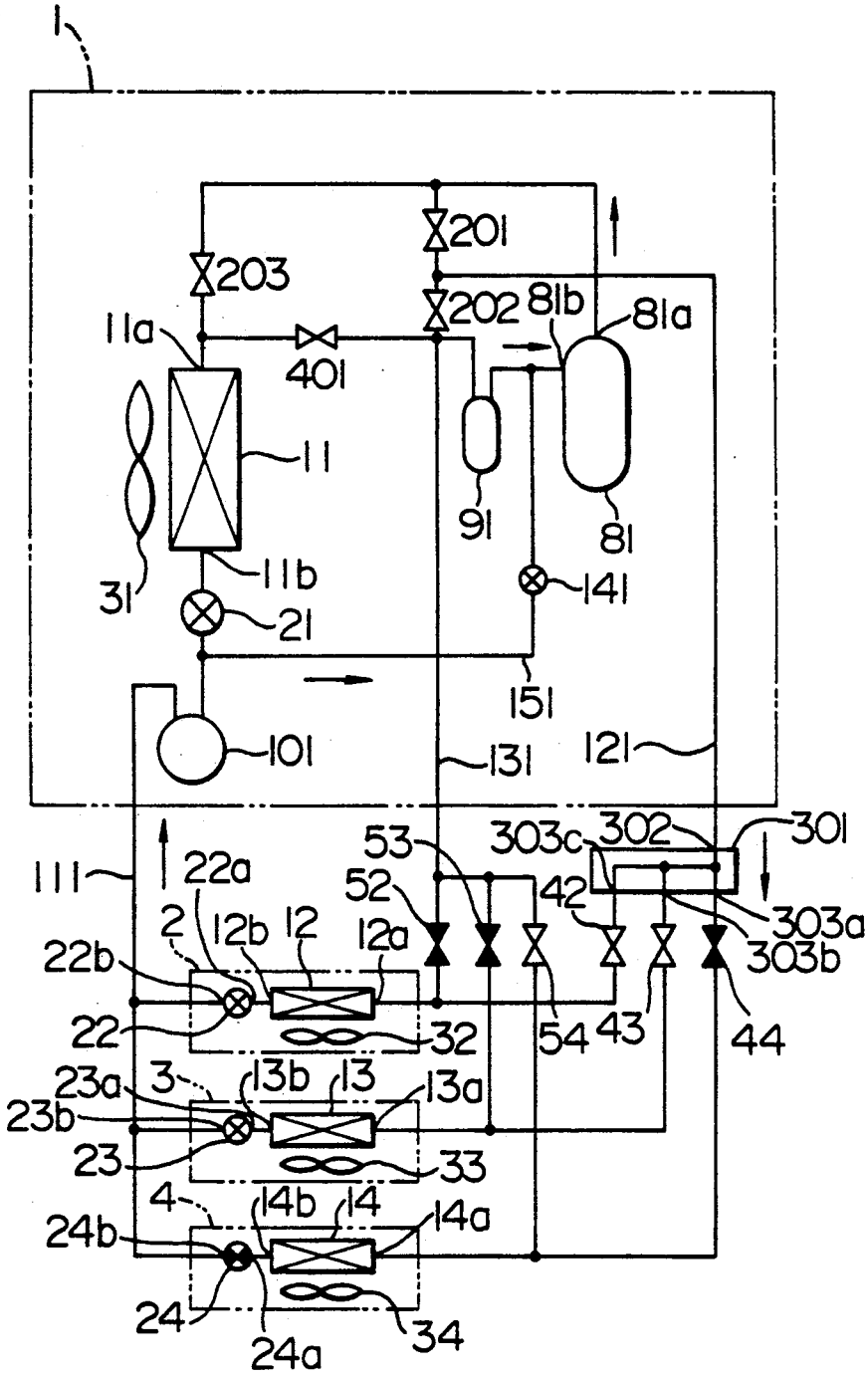
FIG. 1 is a schematic showing an embodiment of the present invention.

A shown in FIG. 1, an air conditioner system according the present invention has a compressor 81 including an inlet port **81*b* through which a refrigerant flows into the compressor 81 and an outlet port 81*a* through which the refrigerant compressed by the compressor 81 flows out of the compressor 81, and a plurality of heat exchanges 12, 13, 14 each of which is either heating or cooling the air in an air-conditioned room as occasion demands and each of which including a heat exchanger first port 12*a*, 13*a*, 14*a* and a heat exchange second port 12*b*, 13*b*, 14*b* between which the refrigerant flows in the heat exchanger 12, 13, 14, respectively, thereby effecting the heat energy from the refrigerant to the air in the air-conditioned room. There is also included a radiator 11 which includes a radiator first port 11*a* and a radiator second port 11*b* between which the refrigerant flows in the radiator 11 to thereby transfer heat energy from the refrigerant to outside of the air-conditioned room and a radiator fan 31 is arranged adjacent to the radiator 11 and is rotated to transfer effectively the heat energy from the refrigerant to the air. Additionally, a plurality of orifices 22, 23, 24 are included each of which having an orifice first port 22*a*, 23*a*, 24*a* and an orifice second port 22*b*, 23*b*, 24*b* between which the compressed refrigerant expands adiabatically, each of the orifices 22, 23, 24 being connected to the heat exchanger second port 12*b*, 13*b*, 14*b* through a connection made with the orifice first part 22*a*, 23*a*, 24*a* and being connected to the radiator second port 11*b* through the orifice second port 22*b*, 23*b*, 24*b*. A plurality of heat exchanger fans 32, 33, 34 are arranged adjacent to the heat exchanges 12, 13, 14, respectively, and re rotated to transfer effectively the heat energy from the refrigerant to the air. The heat exchanges 12, 13, 14, the orifice 22, 23, 24 and the heat exchanger fans 32, 33, 34 form respective heat exchanger units 2, 3, 4. When a heat exchanger 12, 13, 14 is neither heating or cooling the air in the air-conditioned room, the corresponding orifice 22, 23, 24 connected thereto may be substantially closed or the rotation of the corresponding heat exchanger fan 32, 33, 34 may be stopped. Further valves (not shown) may be connected to each heat exchanger 12, 13, 14 so as to shut off the flow of refrigerant therethrough. Between the heat exchanger units 2, 3, 4 and the radiator 11, the orifice second port 22*b*, 23*b*, 24*b* is connected to an end of a pipe 111, another end of the pipe 111 being connected to the radiator second port 11*b*. A receiver 101 is arranged on the pipe 111 for receiving the liquefied refrigerant, and a radiator orifice 21 is arranged between the receiver 101 and the radiator second port 11*b* on the pipe 111 so that adiabatic expansion is effected therein when the adiabatic expansion is not sufficiently effected in the orifice 22, 23, 24 connected to the heat exchanger 12, 13, 124 heating the air. The degree of the opening of each orifice 22, 23, 24 and that of the radiator orifice 21 are adjustable and can be shut off substantially completely so that the flow in the heat exchanger 12, 13, 14 or in the radiator 11 can be stopped substantially completely when the transfer of heat energy in the heat exchanger 12, 13, 14 or in the radiator 11** is not needed.

The air-conditioner system according to the embodiment in FIG. 1 further comprises a manifold 301 including a main port 302 and a plurality of sub-port **303*a*, 303*b*, 303*c* capable of communicating respectively with the heat exchanger first ports 12*a*, 13*a*, 14*a* so that the heat exchanger first ports 12*a*, 13*a*, 14*a* can communicate with the main port 301 through the respective sub-port 303*a*, 303*b*, 303*c* in the manifold 301. The flow direction control device 201, 202, 203 is arranged between the compressor 81 and the main port 302 and between the outlet port 81*a* and the radiator first port 11*a*. The flow direction control device 201, 202, 203 has three two-port valves 201, 202, 203, the two-port valve 201 is arranged between the main port 302 and the outlet port 81*a*, the two-port valve 202 is arranged between the main port 302 and the inlet port 81*b*, and the two-port valve 203 is arranged between the outlet port 81*a* and the radiator first port 11*a*. The main port 302 is connected to the outlet port 81*a* or to the inlet port 81*b* through a pipe 121 by the two port valve 201 or by the two port valve 202**, respectively. The two-port valves 201 is opened, the two-port valve 202 is closed and the two-port valve 203 is opened or closed as occasion demands so that the flow direction control device 201, 202, 203 provides the flow of refrigerant from the outlet port 81*a* to the main port 302 and prevents the flow of refrigerant from the main port 302 to the inlet port 81*b* when at least one of the heat exchanges 12, 13, 14 heats the air in the air-conditioned room. The two-port valve 201 is opened, the two-port valve 202 is closed and the two-port valve 203 is closed so that the flow direction control device 201, 202, 203 prevents the flow of refrigerant from the outlet port 81*a* to the radiator first port 11*a* when at least one of the heat exchanges 12, 13, 14 heats the air in the air-conditioned room and none of the heat exchanges 12, 13, 14 cools the air in the air-conditioned room. However, the two-port valve 201 is closed, the two-port valve 202 is opened and the two-port valve 203 is opened so that the flow direction control device 201, 202, 203 prevents the flow of refrigerant from the outlet port 81*a* to the main port 302 and permits the flow of refrigerant from the outlet port 81*a* to the radiator first port 11*a* and from the main port 302 to the inlet port 81*a* when none of the heat exchanges 12, 13, 14 is heating the air in the air-conditioned room and at least one of the heat exchanger 12, 13, 14 is cooling the air in the air-conditioned room.

When heat energy for heating the air in the air-conditioned room by the heat exchanges 12, 13, 143 is less than heat energy for cooling the air in the air-conditioned room by the heat exchanges 12, 13, 14, the two-port valve 203 is opened to permit the flow of refrigerant to the radiator 11 so that the refrigerant heats (i.e., releases the heat) outside of the air-conditioned rooms at the radiator 11 and, as a result thereof, the refrigerant is cooled. When heat energy for heating the air in the air-conditioned room by the heat exchanges 12, 13, 14 is larger than heat energy for cooling the air in the air-conditioned room by the heat exchanges 12, 13, 14, the two-port valve 203 is closed.

The air-conditioner system according to the present embodiment further comprises a plurality of valve pairs 42/52, 43/53, 44/45, each of the valve pairs 42/52, 43/53, 44/54 including a first valve 42, 43, 44 and a second valve 52, 53, 54, respectively. The heat exchanger first ports 12*a*, 13*a*, 14*a* are respectively connected to the sub-port 303*c*, 303*b*, 303*a* through the respective first valve 42, 43, 44, and the heat exchanger first ports 12*a*, 13*a*, 14*a* are connected to the inlet port 81*b* through the respective second valve 52, 53, 54 and through a pipe 131. In each of the valve pairs 42/52, 43/53, 44/54, the first valve 42, 43, 44 opens to permit the flow of refrigerant between the heat exchanger first port 12*a*, 13*a*, 14*a* and the sub-port 303*a*, 303*b*, 303*c* when the second valve 52, 53, 54 closes thereby preventing the flow of refrigerant between the heat exchanger first port 12*a*, 13*a*, 14*a* and the inlet port 81*b*, and the second valve 52, 53, 54 opens to permit the flow of refrigerant between the heat exchanger first port 12*a*, 13*a*, 14*a* and the inlet port 81*b* when the first valve 42, 43, 44 closes thereby preventing the flow of refrigerant between the heat exchanger first port 12*a*, 13*a*, 14*a* and the sub-port 303*a*, 303*b*, 303*c*. The first valve 42, 43, 44 which is connected to the heat exchanger 12, 13, 14 heating the air in the air-conditioned room is opened and the first valve 42, 43, 44 which is connected to the heat exchanger 12, 13, 14 cooling the air in the air-conditioned room is opened and the first valve 42, 43, 44 which is connected to the heat exchanger 12, 13, 14 cooling the air in the air-conditioned room is closed when at least one of the heat exchanges 12, 13, 14 is heating the air in the air-conditioned room. On the other hand, the first valve 42, 43, 44 which is connected to the heat exchanger 12, 13, 14 cooling the air in the air-conditioned room is opened when one of the heat exchanges 12, 13, 14 is heating the air in the air-conditioned room and none of the heat exchanges 12, 13, 14 is cooling the air in the air-conditioned room. The third valve 401 becomes closed so as to prevent the flow of refrigerant from the radiator first port 11*a*, that is when the two-port valve 203 is opened. When heat energy for heating the air in the air-conditioned room by the heat exchanger 12, 13, 14 is larger than heat energy for cooling the air in the air-conditioned room by the heat exchanger 12, 13, 14, the third valve 401 is opened so that the refrigerant cools the outside of the air-conditioned rooms at the radiator 11 and the refrigerant is heated.

The refrigerant from the radiator 11 or from the heat exchanger 12, 13, 14 flows into the inlet port 81*a* through an accumulator 91 for holding the pressure of the refrigerant constant at the inlet port 81*a*. A part of the pipe 111 between the receiver 101 and the radiator orifice 21 is connected to the inlet port 81*a* by a pipe 151 on which a flow control valve 141 is arranged to flow a small amount of the refrigerant from the pipe 111 into the inlet port 81*a* so that the temperature of the refrigerant does not vary significantly at the inlet port 81*a*.

Figure 2:
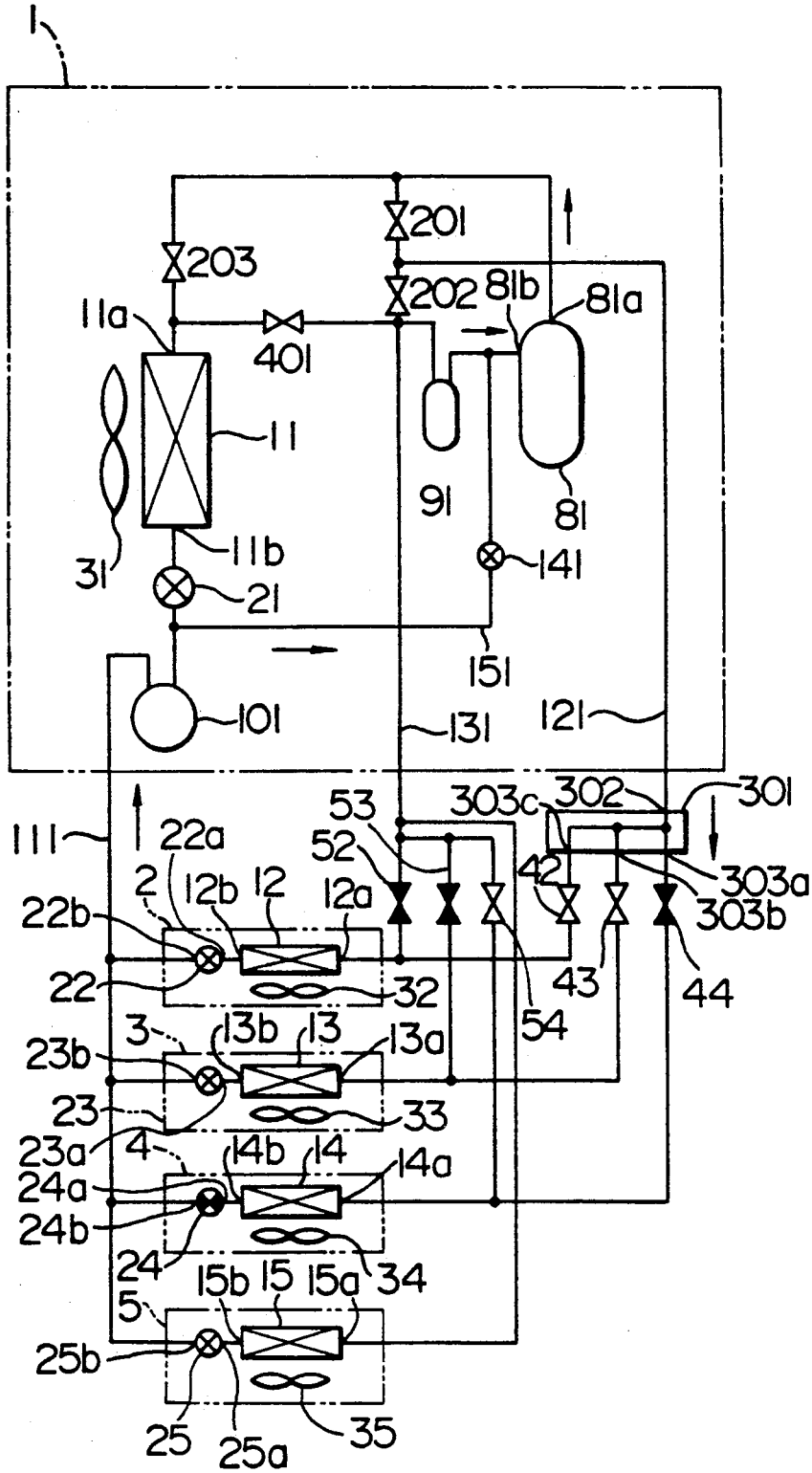
FIG. 2 is a schematic showing a first modification of the embodiment of FIG. 1.

The embodiment shown in FIG. 2 has an addition to the structure shown in FIG. 1 a heat exchanger 15 which only cools air in an air-conditioned room and includes a heat exchanger first port 15*a* and a heat exchanger second port 15 between which the refrigerant flows in the heat exchanger 15 to thereby transfer heat energy from the refrigerant to the air in the air-conditioned room. An orifice 25 is included having an orifice first port 25*a* and an orifice second port 25*b* between which the compressed refrigerant expands adiabatically. The orifice 25 is connected to the heat exchanger second port 15*b* through the orifice first port 25*a* and is connected to the radiator second port 11*b* through the orifice second port 25*b* through the pipe 111 and through receiver 101 on the pipe 171. A heat exchanger fan 35 is arranged adjacent to the heat exchanger 15 and is rotated to transfer effectively the heat energy from the refrigerant to the air. The heat exchanger 15, the orifice 25 and the heat exchanger fan 35 together from a heat exchanger unit 5. The heat exchanger first port 15*a* is connected to the inlet port 81*b* through the pipe 131. Since the heat exchanger 15 always cools the air in the air-conditioned room, the radiator 11 may not be operated, that is, the third valve 401 or the radiator orifice 21 may be closed even when heat energy for heating the air in the air-conditioned room by the heat exchanger 12, 13, 14 is larger than heat energy for cooling the air in the air-conditioned room by the heat exchanges 12, 13, 14. Therefore, the amount of heat energy transferred from the refrigerant to the outside of the air-conditioned rooms is small, that is, a large part of the heat energy circulates between the rooms being heated and the rooms being cooled.

Figure 3:
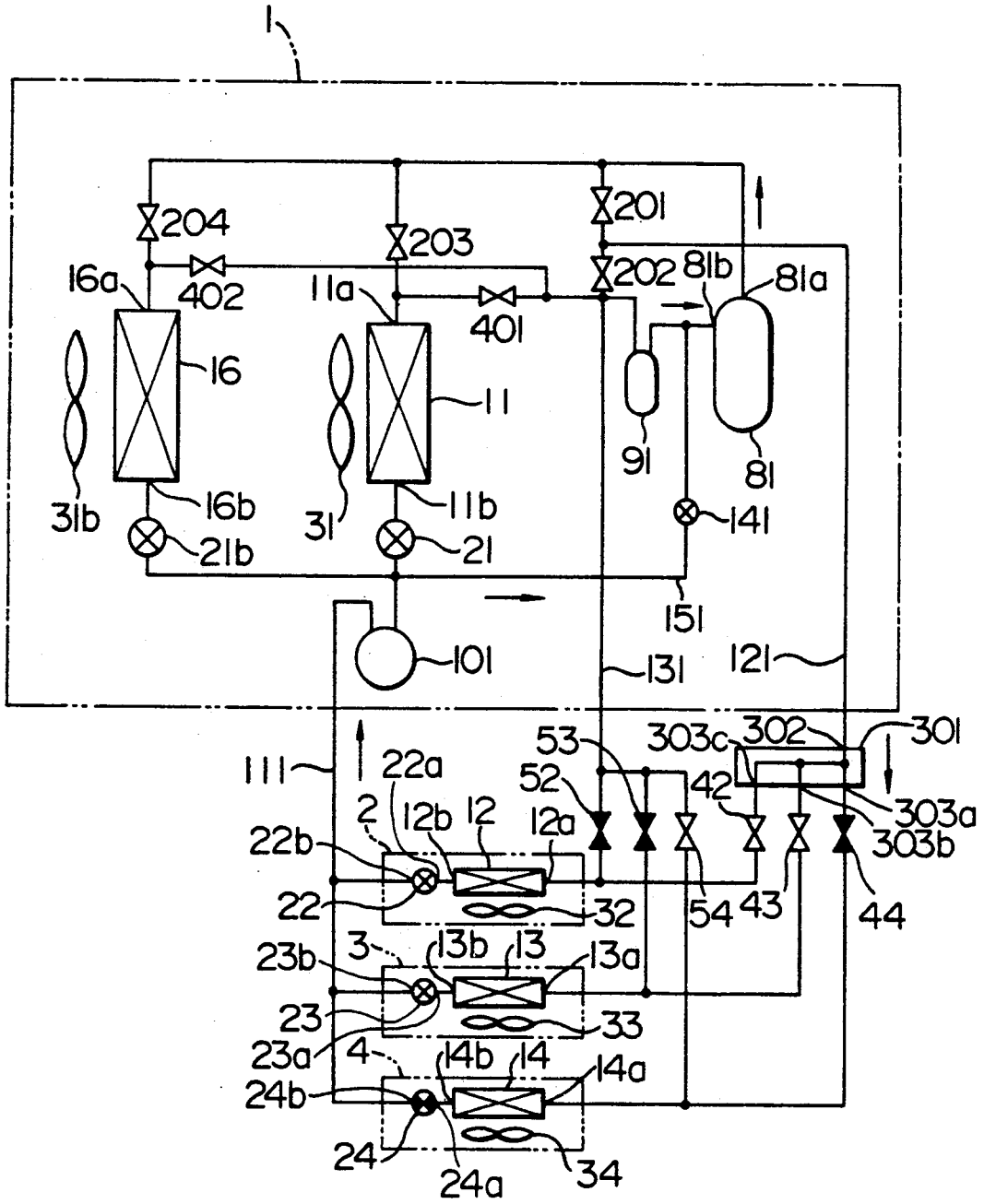
FIG. 3 is a schematic showing a second modification of the embodiment of FIG. 1.

The embodiment shown in FIG. 3 has in addition to the structure shown in FIG. 1 a sub-radiator 16 which includes a sub-radiator first port 16*a* and a sub-radiator second port 16*b* between which the refrigerant flows in the sub-radiator 16 to thereby transfer heat energy from the refrigerant to the outside of the air-conditioned room and a sub-radiator fan 31*b* is arranged adjacent to the sub-radiator 16 and is rotated to transfer effectively the heat energy from the refrigerant to the air. Each of the orifices 22, 23, 24 is connected to the sub-radiator second port 16*b* through the orifice second port 22*b*, 23*b*, 24*b* and through the receiver 101 on the pipe 111. A sub-radiator orifice 21*b* is arranged between the receiver 101 and the sub-radiator second port 16*b* on the pipe 111 so that adiabatic expansion is effected therein when the adiabatic expansion is not sufficiently effected in the orifice 22, 23, 24 connected to the heat exchanger 12, 13, 14 heating the air. The degrees of the opening of the sub-radiator orifice 21*b* is adjustable and can be shut off substantially completely so that the flow in the sub-radiator 16 can be stopped substantially completely when the transferring of the heat energy is not needed in the sub-radiator 16. A two-port valve 204 is arranged between the outlet port 81*a* and the sub-radiator first port 16*a*. A two port valve 402 is arranged between the inlet port 81*b* and the sub-radiator first port 16*a*. The two-port valve 204 permits the flow of refrigerant from the outlet port 81*a* to the sub-radiator first port 16*a* when at least one of the heat exchanges 12, 13, 14 cools the air in the air-conditioned room, and prevents the flow of refrigerant from the outlet port 81*a* to the sub-radiator first port 16*a* when none of the heat exchanges 12, 13, 14 is cooling the air in the air-conditioned room. The two-port valve 204 permits the flow of refrigerant from the outlet port 81*a* to the sub-radiator first port 16*a* when a sum of heat energy for heating the air in the air-conditioned room by the heat exchanges 12, 13, 14 and heat energy heating the outside of the air-conditioned room by the radiator 11 is less than the heat energy for cooling the air in the air-conditioned room by the heat exchanges 12, 13, 14. The two-port valve 204, however, does not permit the flow of refrigerant from the outlet port 81*a* to the sub-radiator first port 16*a* when a sum of heat energy for heating the air in the air-conditioned room by the heat exchanges 12, 13, 14 and heat energy heating the outside of the air-conditioned room by the radiator 11 is more than heat energy for cooling the air in the air-conditioned room by the heat exchanges 12, 13, 14. The two-port valve 402 prevents the flow of refrigerant from the sub-radiator first port 16*a* to the inlet port 81*a* when the two-port valve 204 permit the flow of refrigerant from the outlet port 81*a* to the sub-radiator first port 16*a*. The two-port valve 402 permits the flow of refrigerant from the sub-radiator first port 16*a* to the inlet port 81*a* when the heat energy for heating the air in the air-conditioned room by the heat exchanges 12, 13, 14 is more than a sum of the heat energy cooling the outside of the air-conditioned room by the radiator 11 and the heat energy for cooling the air in the air-conditioned room by the heat exchanges 12, 13, 14.

Figure 4:
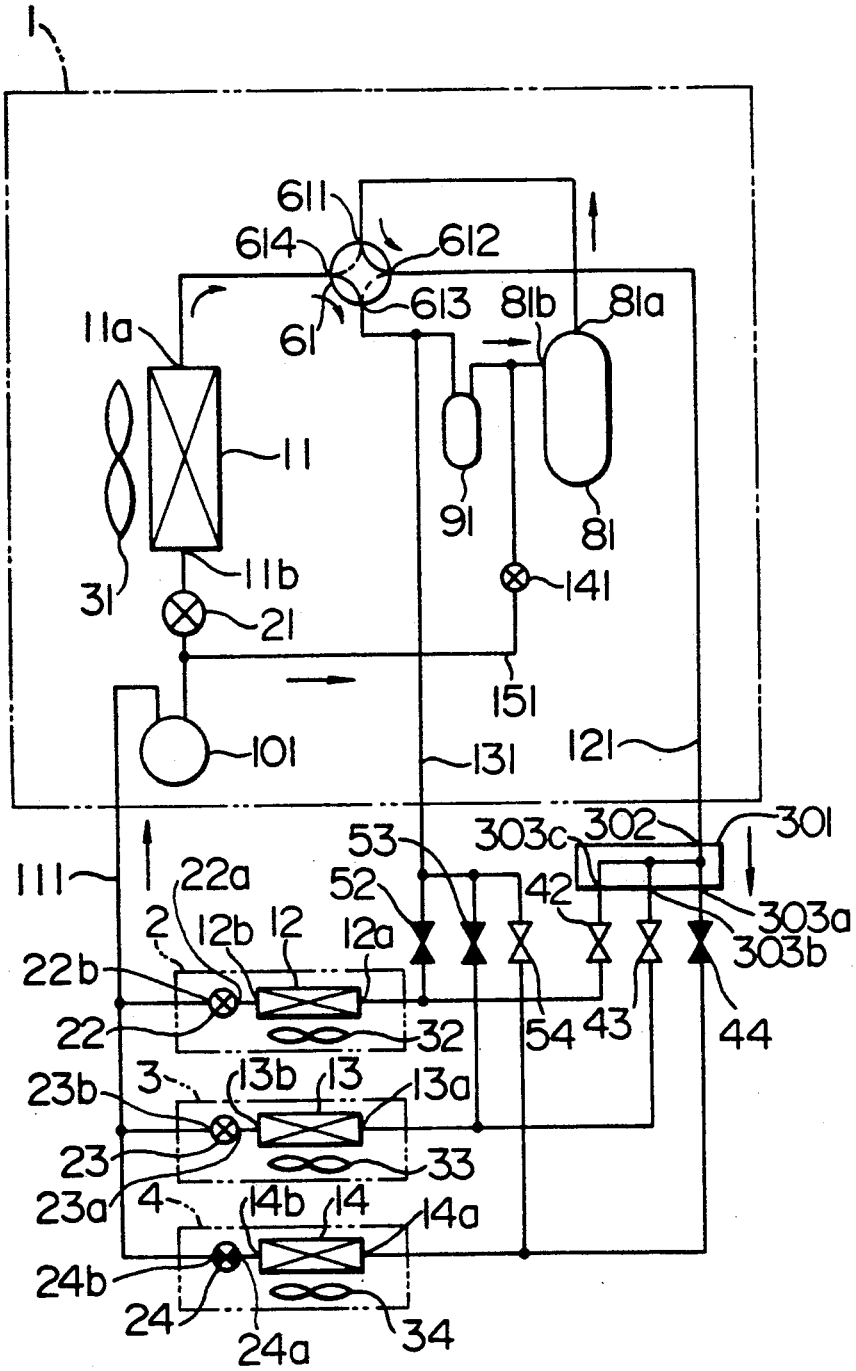
FIG. 4 is a schematic showing a third modification of the embodiment of FIG. 1.

In the embodiment shown in FIG. 4, a combination of the flow direction control device 201, 202, 203 and the third valve 401 as shown in FIG. 1 is replaced by a two-position four-ports valve 61. The two-position four-ports valve 61 has a first opening 611 connected to the outlet 81*a*, a second opening 612 connected to the main port 302, a third opening 613 connected to the inlet 81*b* and a fourth opening 614 connected to the radiator first port 11*a*. The first opening 611 communicates with the second opening 612 and the third opening 613 communicates with the fourth opening 614 at a first position of the two-position four-ports valve 61. The first opening 611 communicates with the fourth opening 614 and the third opening 613 communicates with the second opening 612 at a second position of the two-position four-ports valve 61. When none of the heat-exchanges 12, 13, 14 is heating the air in the air-conditioned room and at least one of the heat exchanges 12, 13, 14 is cooling the air in the air-conditioned room, the two-position four-ports valve 61 is set at the second position. When at least one of the heat exchanges 12, 13, 14 is heating the air in the air-conditioned room, the two position four-ports valve 61 is set at the first position. Therefore, the refrigerant can not flow from the outlet port 81*a* to the radiator first port 11*a* even when heat energy for heating the air in the air-conditioned room by the heat exchanges 12, 13, 14 is less than heat energy for cooling the air in the air-conditioned room by the heat exchanges 12, 13, 14. This notwithstanding, however, the structure is simplified in comparison with the embodiment of FIG. 1.

The embodiment shown in FIGS. 5A to 5D has in addition tot the structure shown in FIG. 4 a sub-radiator 16 which includes a sub-radiator first port 16*a* and a sub-radiator second port 16*b* between which the refrigerant flows in the sub-radiator 16 to transfer heat energy from the refrigerant to the outside of the air-conditioned room and a radiator fan 31 is arranged adjacent to the sub-radiator 16 and to the radiator 11 and is rotated to transfer effectively the heat energy from the refrigerant to the air. Each of the orifices 22, 23, 24 is connected to the sub-radiator second port 16*b* through the respective orifice second port 22*b*, 24*b* and through the receiver 101 on the pipe 111. A sub-radiator orifice 21*b* is arranged between the receiver 101 and the sub-radiator second port 16*b* on the pipe 111 so that adiabatic expansion is effected therein when the adiabatic expansion is not sufficiently effected in the orifice 22, 23, 24 connected to the heat exchanger 12, 13, 14 heating the air. The degree of the opening of the sub-radiator orifice 21*b* is adjustable and can be shut off substantially completely so that the flow in the sub-radiator 16 can be stopped substantially completely when transfer of the heat energy is not needed in the sub-radiator 16. A sub-two-position four-ports valve 61*b* is arranged between the compressor 81 and the main port 302 and between the compressor 81 and the sub-radiator first port 16*a*. A one-way valve 71 is arranged between the main port 302 and the sub two-positioned four-ports valve 61*b* so that the refrigerant can flow from the sub-two-position four-ports valve 61*b* to the main port 302 but the refrigerant cannot flow from the main port 302 to the sub-two-position four-ports valve 61*b*. The sub-two-position four-ports valve 61*b* has a first opening 611*b* connected to the outlet 81*a*, a second opening 612*b* connected to the main port 302 through the one-way valve 71, a third opening 613*b* connected to the inlet 81*b* and a fourth opening 614*b* connected to the sub-radiator first port 16*a*. The first opening 611*b* communicates with the second opening 612*b* and the third opening 613*b* communicates with the fourth opening 614*b* at a first position of the sub-two-position four-ports valve 61*b*. The first opening 611*b* communicates with the fourth opening 614*b* and the third opening 613*b* communicates with the second opening 612*b* at a second position of the sub-two-position four-ports valve 61*b*. The sub-two-position four-ports valve 61*b* is set at the second position of the sub-two-position four-ports valve 61*b* and the radiator 11 is prevented from flowing the refrigerant therein when at least one of the heat exchanges 12, 13, 14 is heating the air in the air-conditioned room and corresponding the heat energy for heating the air in the air-conditioned room by the heat exchanges 12, 13, 14 is less than heat energy for cooling the air in the air-conditioned room by the heat exchanges 12, 13, 14 is less than heat energy for cooling the air in the air-conditioned room by the heat exchanges 12, 13, 14. The sub-two-position four-ports valve 61*b* is also set at the second position of the sub-two-position four-ports valve 61*b* when none of the heat-exchanges 12, 13, 14 is heating the air in the air-conditioned room and at least one of the heat exchanges 12, 13, 14 is cooling the air in the air-conditioned room and the heat energy heating the outside of the air-conditioned room by the radiator 11 is less than heat energy for cooling the air in the air-conditioned room by the heat exchanges 12, 13, 14. The sub-two-position four-ports valve 61*b*, however, is set at the first position of the sub-two-position four-ports valve 61*b* when at least one of the heat exchanges 12, 13, 14 is heating the air in the air-conditioned room and the heat energy for heating the air in the air-conditioned room by the heat exchanges 12, 13, 14 is more than a sum of the heat energy cooling the outside of the air-conditioned room by the radiator 11 and the heat energy for cooling the air in the air-conditioned room by the heat exchanges 12, 13, 14.

Figure 5B:
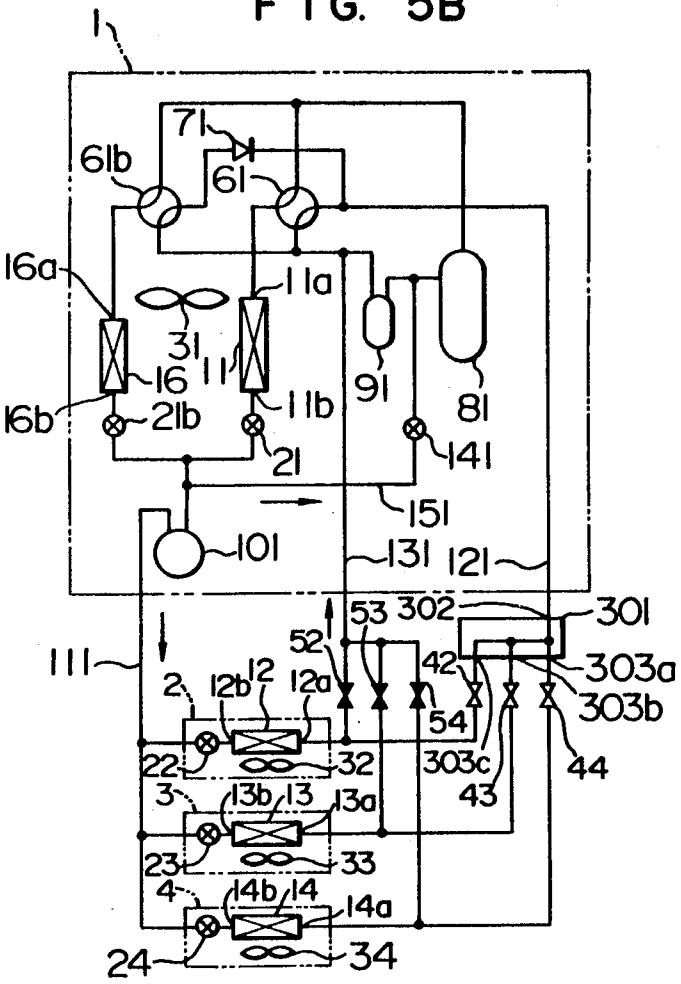
FIGS. 5A, 5B, 5C and 5D are schematics showing respective operational stages of a modification of the embodiment of FIG. 4.
Figure 5A:
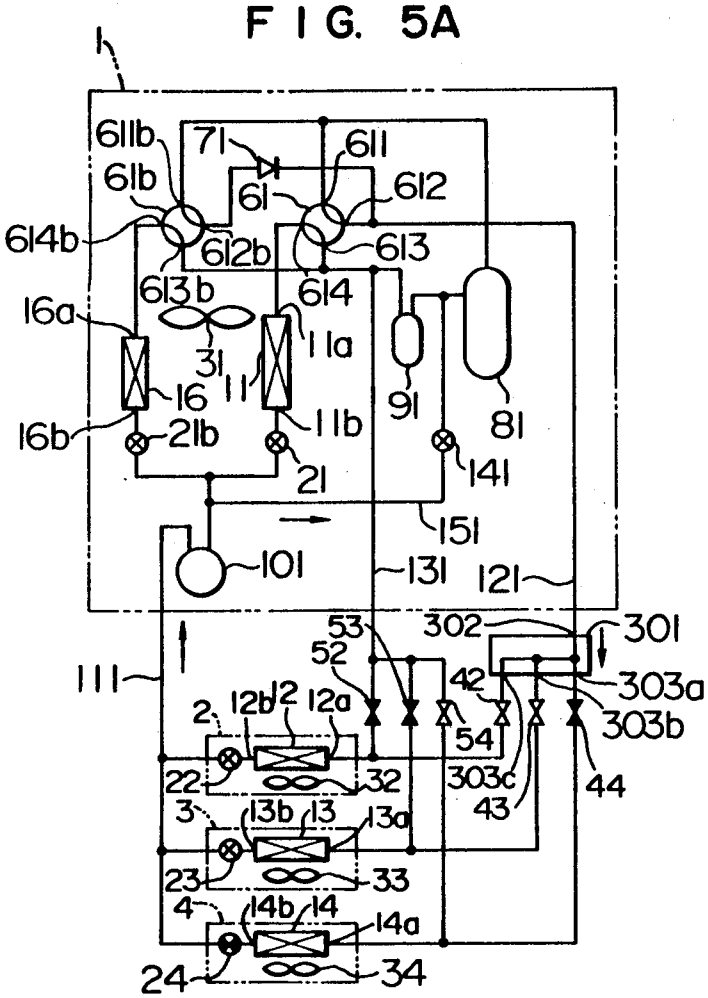

In an operational stage shown in FIG. 5A, since the heat exchanges 12, 13 are heating the air in the air-conditioned room and the heat energy for heating the air in the air-conditioned room by the heat exchanges 12, 13 is not less than heat energy for cooling the air in the air-conditioned room by the non-operating heat exchanger 14, the sub-two-position four-ports valve 61*b* is set at the first position of the sub-two-position four-ports valve 61*b*. But, since the heat energy for heating the air in the air-conditioned room by the heat exchanges 12, 13 is not more than a sum of the heat energy cooling the outside of the air-conditioned room by the radiator 11 and the heat energy for cooling the air in the air-conditioned room by the non-operating heat exchanger 14, the sub-radiator orifice 21*b* prevents the refrigerant from flowing in the sub-radiator 16.

In an operational stage shown in FIG. 5B, since none of the heat exchanges 12, 13, 14 is heating the air in the air-conditioned room and all of the heat exchanges 12, 13, 14 are cooling the air in the air-conditioned room and the heat energy heating the outside of the air-conditioned room by the radiator 11 is less than heat energy for cooling the air in the air-conditioned room by the heat exchanges 12, 13, 14, the sub-two-position four-ports valve 61*b* is set at the second position of the sub-two-position four-ports valve 61*b*. That is, all of the first valves 42, 43, 44 are opened so as to permit the flow of refrigerant from the heat-exchanges 12, 13, 14 to the inlet 81*b*.

Figure 5D:
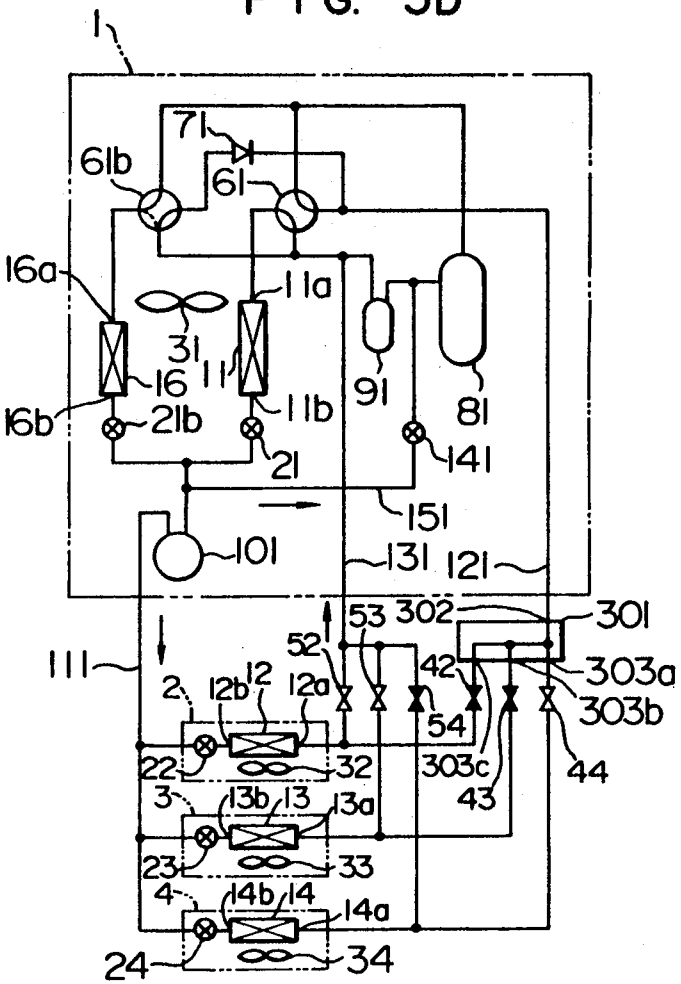
Figure 5C:
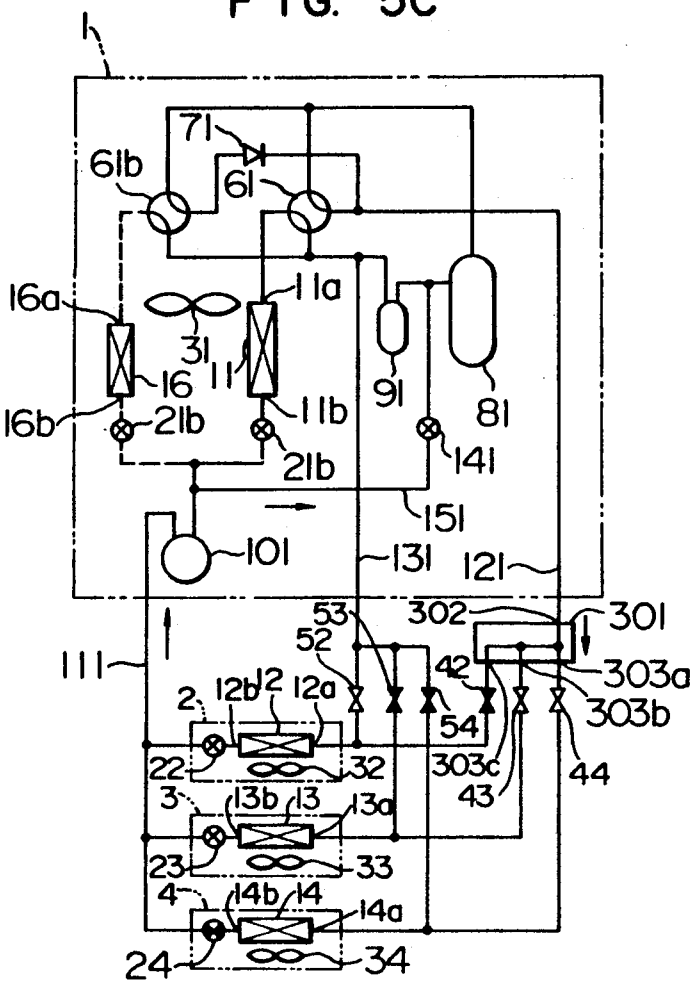

In an operational stage shown in FIG. 5C, since the heat exchanges 13, 14 are heating the air in the air-conditioned room and the corresponding heat energy for heating the air in the air-conditioned room by the heat exchanges 13, 14 is more than a sum of the heat energy for cooling the air in the air-conditioned room by the heat exchanger 12, the sub-two-position four-ports valve 61*b* is set at the first position of the sub-two-position four-ports valve 61*b*. But, since the heat energy for heating the air in the air-conditioned room by the heat exchanges 13, 14 is not significantly larger than a sum of the heat energy cooling the outside of the air-conditioned room by the radiator 11 and the heat energy for cooling the air in the air-conditioned room by the heat exchanger 12, the degree of the opening of the sub-radiator orifice 21*b* is controlled to thereby decrease the flow rate in the sub-radiator 16 so that the heat energy for heating the air in the air-conditioned room by the heat exchanges 13, 14 is substantially equal to a sum of the heat energy cooling the outside of the air-conditioned room by the radiator 11 and by the sub-radiator 16 and the heat energy for cooling the air in the air-conditioned room by the heat exchanger 12.

In an operational stage shown in FIG. 5D, since the heat exchanger 14 is heating the air in the air-conditioned room and the corresponding heat energy for heating the air in the air-conditioned room by the heat exchanger 14 is less than heat energy for cooling the air in the air-conditioned room by the heat exchanges 12, 13, the sub-two-position four-ports valve 61*b* is set at the second position of the sub-two-position four-parts valve 61*b* and the two-position four-ports valve 61 is set at the first position and the radiator 11 is prevented from flowing the refrigerant from the radiator second port 11*b* to the radiator first port 11*a* by shutting off completely the radiator orifice 21.

Figure 6:
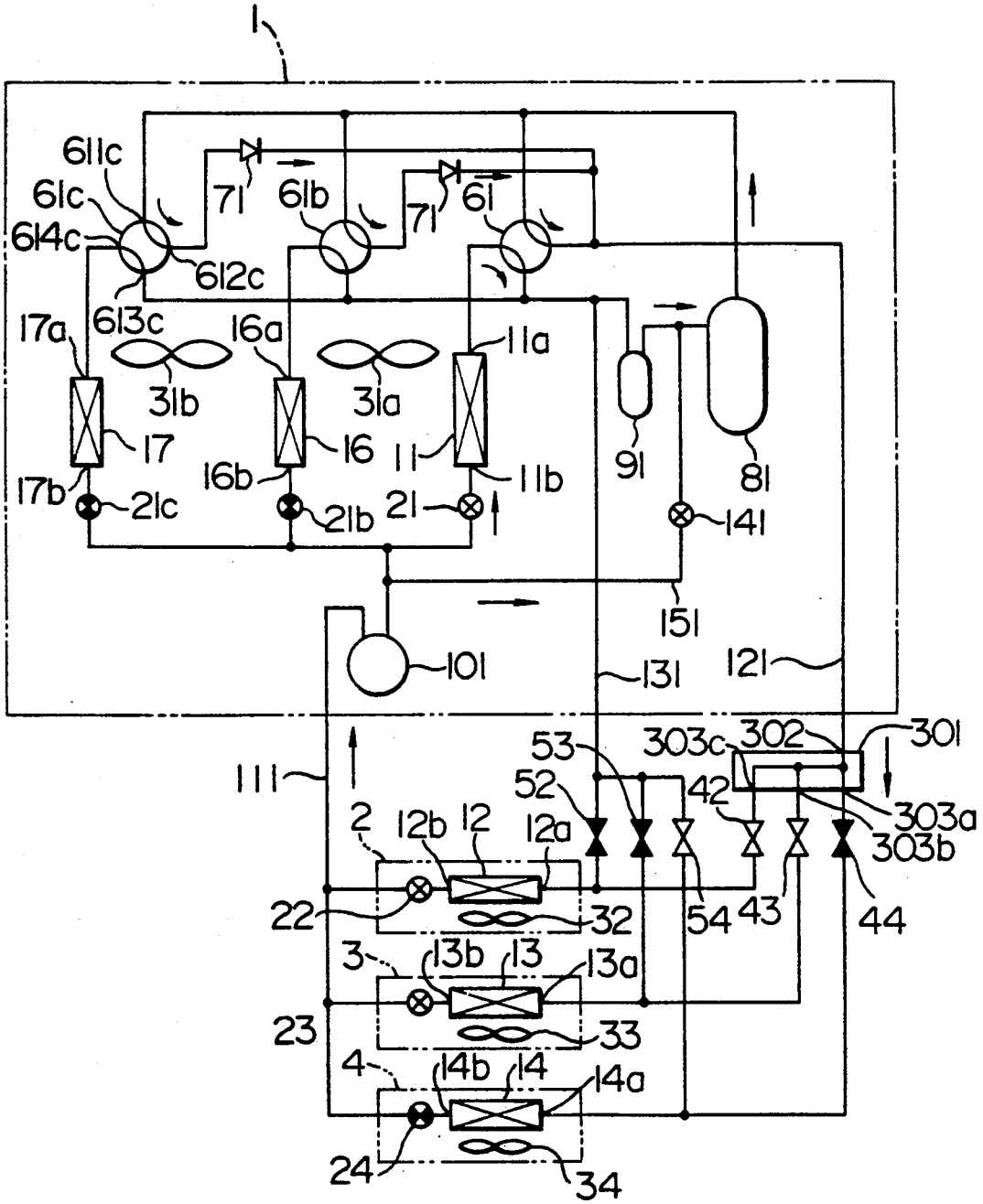
FIG. 6 is a schematic showing a fourth modification of the embodiment of FIG. 1.

The embodiment shown in FIG. 6 has in addition to the structure shown in FIGS. 5A to 5D, a second sub-radiator 17 which includes a second sub-radiator first port 17*a* and a second sub-radiator second port 17*b* between which the refrigerant flows in the second sub-radiator 17 to transfer heat energy from the refrigerant to the outside of the air-conditioned room and a radiator fan 31*b* is arranged adjacent to the second sub-radiator 17 and to the sub-radiator 16 and is rotated to transfer effectively the heat energy from the refrigerant to the air. Each of the orifices 22, 23, 24 is connected to the second sub-radiator second port 17*b* through the respective orifice second port 22*b*, 23*b*, 24*b* and through the receiver 101 on the pipe 111. A sub-radiator orifice 21*c* is arranged between the receiver 101 and the sub-radiator second port 17*b* on the pipe 111 so that adiabatic expansion is effected therein when the adiabatic expansion is not sufficiently effected in the orifice 23, 23, 24 connected to the heat-exchanger 12, 13, 14 heating the air. The degree of the opening of the sub-radiator orifice 21*c* is adjustable and can be shut off substantially completely so that the flow in the second sub-radiator 17 can be stopped substantially completely when transfer of the heat energy is not needed in the second sub-radiator 17. Another sub-two-position four-ports valve 61*c* is arranged between the compressor 81 and the main port 302 and between the compressor 81 and the second sub-radiator first port 17*a*. A one-way valve 71 is arranged between the main port 301 and the sub-two-position four-ports valve 61*c* so that the refrigerant can flow from the sub-two-position four-ports valve 61*c* to the main port 302 but the refrigerant is prevented from flowing from the main port 302 to the sub-two-position four-ports valve 61*c*. The sub-two-position four-ports valve 61*c* has a first opening 611*c* connected to the outlet 81*a*, a second opening 612*c* connected to the main port 302 through the one-way valve 71, a third opening 613*c* connected to the inlet 81*b* and a fourth opening 614*c* connected to the sub-radiator first port 17*a*. The first opening 611*c* communicates with the second opening 612*c* and the third opening 613*c* communicates with the fourth opening 614*c* at a first position of the sub-two-position four-ports valve 61*c*. The first opening 611*c* communicates with the fourth opening 614*c* and the third opening 613*c* communicates fourth opening 614*c* at a first position of the sub-two-position four-ports valve 61*c*. The sub-two-position four-ports valve 61c is set at the second position of the sub-two-position four-ports valve 61c and the radiator 11 is prevented from flowing the refrigerant therein when at least one of the heat exchanges 12, 13, 14 is heating the air in the air-conditioned room and the corresponding heat energy for heating the air in the air-conditioned room by the heat exchanges 12, 3, 14 is less than a sum of the heat energy for cooling the air in the air-conditioned room by the heat exchanges 12, 13, 14 and the heat energy cooling the outside of the air-conditioned room by the sub-radiator 16. The sub-two-position four-ports valve 61c is also set at the second position of the sub-two-position four-ports valve 61c when none of the heat exchanges 12, 13, 14 is heating the air in the air-conditioned room and at least one of the heat exchanges 12, 13, 14 is cooling the air in the air-conditioned room and the heat energy heating the outside of the air-conditioned room by the radiator 11 and by the sub-radiator 16 is less than the heat energy for cooling the air in the air-conditioned room by the heat exchanges 12, 13, 14. The sub-two-position four-ports valve 61c is, however, set at the first position of the sub-two-position four-ports valve 61c then at least one of the heat exchanges 12, 13, 143 is heating the air in the air-conditioned room and the heat energy for heating the air in the air-conditioned room by the heat exchanges 12, 13, 14 is more than sum of the heat energy cooling the outside of the air-conditioned room by the radiator 11 and by the sub-radiator 16 and the heat energy for cooling the air in the air-conditioned room by the heat exchanges 12, 13, 14.

Figure 7:
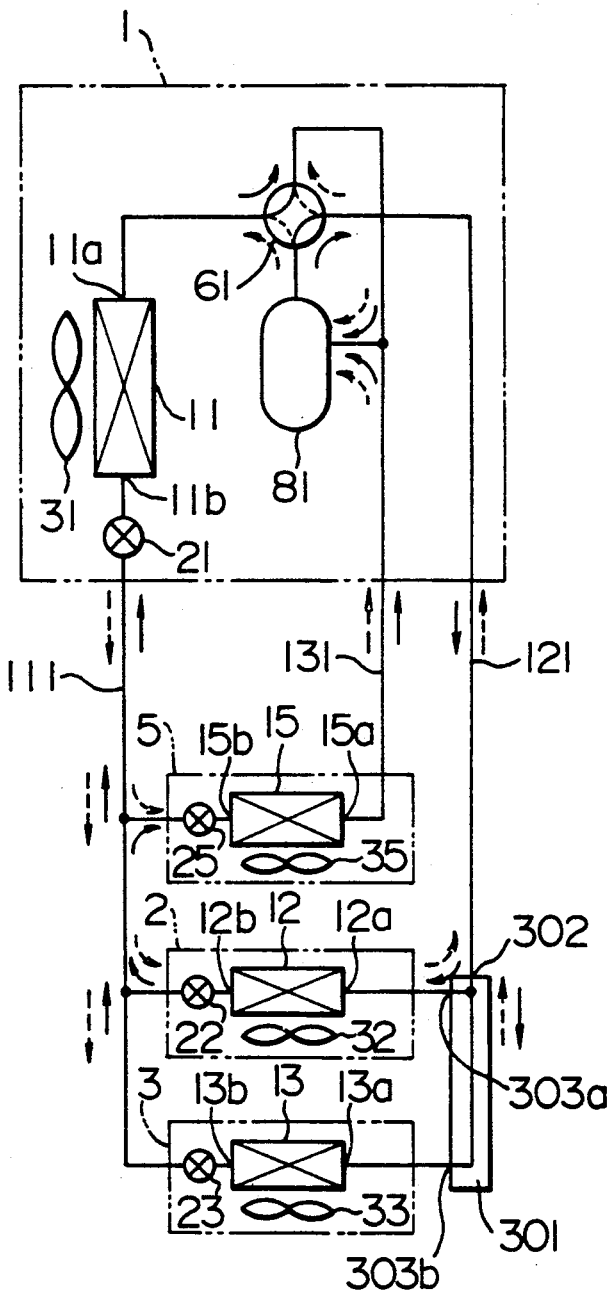
FIG. 7 is a schematic showing a modification of the embodiment of FIG. 2.

In FIG. 7, showing a modification of the present invention, the modification has in addition to the structure shown in FIG. 6 the heat exchanger 15 which only cools air in the air-conditioned room. The heat exchanger first port 15a is connected to the inlet port 81a through the pipe 131. Since the heat exchanger 15 always cools the air in the air-conditioned room, the radiator 11 may no be operated, even when heat energy for heating the air in the air-conditioned room, by the heat exchanges 12, 13 is larger than zero. Therefore, the amount of the heat energy being transferred from the refrigerant to the outside of the air-conditioned rooms becomes small, that is, a large part of the heat energy remains circulating between the rooms being heated and the rooms being cooled. The valve pairs 42/52, 43/53, 44/54 are not arranged between the manifold 301 and the heat exchanges 12, 13. The two-position four-ports valve 61 is set at the first position thereof when at least one of the heat exchanges 12, 13 is heating the air in the air-conditioned room, and the two-position four-ports valve 61 is set at the second position thereof when none of the heat exchanges 12, 13 is heating the air in the air-conditioned room and at least one of the heat exchanges 12, 13, 15 is cooling the air in the air-conditioned room.

What is claimed is:

1. An air-conditioner system comprising:

compressor means including an inlet port through which refrigerant flows into the compressor means and an outlet port through which the refrigerant compressed by the compressor means flows out of the compressor means;

a plurality of heat exchanger means each of which is adapted for either heating or cooling air in an air-conditioned room as occasion demands and includes a heat exchanger first port and a heat exchanger second port between which the refrigerant flows in the heat exchanger means to transfer heat energy from the refrigerant to the air in the air-conditioned room;

radiator means which includes a radiator first port and a radiator second port between which the refrigerant flows in the radiator means to transfer heat energy from the refrigerant to the outside of the air-conditioned room;

a plurality of orifice means each of which includes an orifice first port and an orifice second port between which the compressed refrigerant expands adiabatically, and each of the orifice means connected, through the orifice first port, to the heat exchanger second port, of a respective one of the plurality of heat exchanger means, and connected to the radiator second port through the orifice second port;

manifold means including main port means and a plurality of sub-port means connected to the heat exchanger first ports, respectively, the heat exchanger first ports communicating with the main port means through the respective sub-port means in the manifold means;

flow direction control means arranged between the compressor means and the main port means and between the outlet port and the radiator first port, wherein the flow direction control means flows the refrigerant from the outlet port to the main port means and does not flow the refrigerant from the main port means to the inlet port when at least one of the heat means is heating the air in the air-conditioned room, the flow direction control means does not flow the refrigerant from the outlet port to the radiator first port when at least one of the heat exchanger means is heating the air in the air-conditioned room and none of the heat-exchanger means is cooling the air in the air-conditioned room, and the flow direction control means does not flow the refrigerant from the outlet port to the main port means, flows the refrigerant from the outlet port to the radiator first port and flows the refrigerant from the main port means to the inlet port when none of the heat exchanger means is heating the air in the air-conditioned room and at least one of the heat exchanger means is cooling the air in the air-conditioned room;

a plurality of valve pairs, each of the valve pairs including first valve means and second valve means, the heat exchanger first ports being connected to the respective sub-port means through the respective valve means, the heat exchanger first ports being connected to the inlet port through the respective second valve means, wherein in each of the valve pairs the first valve means opening to flow the refrigerant between the heat exchanger first port and the sub-port means when the second valve means closes thereby preventing the flow of the refrigerant between the heat-exchanger first port and the inlet port and the second valve means opening to flow the refrigerant between the heat exchanger first port and the inlet port when the first valve means closes thereby preventing the flow of the refrigerant between the heat exchanger first port and the sub-port, and wherein the first valve means which is connected to the heat exchanger means heating the air in the air-conditioned room is opened and the first valve means which is connected to the heat exchanger means cooling the air in the air-conditioned room is closed when at least one of the heat exchanger means is heating the air in the air-conditioned room, the first valve means which is connected to the heat exchanger means cooling the air in the air-conditioned room is opened when none of the heat exchanger means is heating the air in the air-conditioned room and at least one of the heat exchanger means is cooling the air in the air-conditioned room; and third valve means arranged between the inlet port and the radiator first port, the third valve means opening to flow the refrigerant from the radiator first port to the inlet port when at least one of the heat exchanger means is heating the air in the air-conditioned room and none of the heat exchanger means is cooling the air in the air-conditioned room, the third valve means closing thereby preventing the flow of the refrigerant from the radiator first port to the inlet port when the flow direction control means flows the refrigerant from the outlet port to the radiator first port.

2. An air-conditioner system according to claim 1, wherein the third valve means flows the refrigerant from the radiator first port to the inlet port and the flow direction control means prevents the flow of the refrigerant from the outlet port to the radiator first port when at least one of the heat exchanger means heats the air in the air-conditioned room, the third valve means and the flow direction control means are combined integrally with each other to form a two-position four-ports valve, the two-position four-ports valve has a first opening connected to the outlet, a second opening connected to the main port, a third opening connected to the inlet and a fourth opening connected to the radiator first port, the first opening communicates with the second opening and the third opening communicates with the fourth opening at a final position of the two-position four-ports valve, the first opening communicates with the fourth opening and the third opening communicates with the second opening at a second position of the two-position four-ports valve, the two-position four-ports valve is set at the second position when none of the heat exchangers is heating the air in the air-conditioned room and at least one of the heat exchangers is cooling the air in the air-conditioned room, and the two-position four-ports valve is set at the first position when at least one of the heat exchangers is heating the air in the air-conditioned room.

3. An air-conditioner system according to claim 1, further comprising:

a heat exchanger which only cools air in an air-conditioned room and includes a heat exchanger first port and a heat exchanger second port between which the refrigerant flows in the heat exchanger to transfer heat energy from the refrigerant to the air in the air-conditioned room, an orifice which includes an orifice first port and an orifice second port between which the compressed refrigerant expands adiabatically, the heat exchanger first port thereof is connected to the inlet port, the orifice is connected to the heat exchanger second port thereof through the orifice first port and connected to the radiator second port through the orifice second port.

4. An air-conditioner system according to claim 1, wherein the flow direction control means flows the refrigerant from the outlet port to the radiator when heat energy for heating the air in the air-conditioned room by the heat exchangers is less than heat energy for cooling the air in the air-conditioned room by the heat exchangers, the flow direction control means does not flow the refrigerant from the outlet port to the radiator when heat energy for heating the air in the air-conditioned room by the heat exchanger is larger than heat energy for cooling the air in the air-conditioned room by the heat exchanger, the third valve means flows the refrigerant from the radiator to the inlet port when heat energy for heating the air in the air-conditioned room by the heat exchanger is larger than heat energy for cooling the air in the air-conditioned room by the heat exchanger.

5. An air-conditioner system according to claim 1, further comprising:

a sub-radiator which includes a sub-radiator first port and a sub-radiator second port between which the refrigerant flows in the sub-radiator to transfer heat energy from the refrigerant to the outside of the air-conditioned room, each of the plurality of orifice means being connected to the sub-radiator second port through the orifice second port, a sub-radiator orifice between the plurality of orifice means and the sub-radiator second port, a first two port valve connecting the outlet port to the sub-radiator first port and a second two port valve connecting the inlet port and the sub-radiator first port, the first two-port valve being capable of flowing the refrigerant from the outlet port to the sub-radiator first port when at least one of the heat exchangers is cooling the air in the air-conditioned room and prevents the flow of the refrigerant from the outlet port to the sub-radiator first port when none of the heat exchangers is cooling the air in the air-conditioned room, the first two-port valve flows the refrigerant from the outlet port to the sub-radiator first port when a sum of heat energy for heating the air in the air-conditioned room by the heat exchangers and heat energy heating the outside of the air-conditioned room by the radiator is less than heat energy for cooling the air in the air-conditioned room by the heat exchangers, the first two-port valve prevents the flow of the refrigerant from the outlet port to the sub-radiator first port when a sum of heat energy for heating the air in the air-conditioned room by the heat exchangers and heat energy heating the outside of the air-conditioned room by the radiator is more than heat energy for cooling the air in the air-conditioned room by the heat exchangers, the second two port valve prevents the flow of the refrigerant from the sub-radiator first port to the inlet port when the first two-port valve flows the refrigerant from the outlet port to the sub-radiator first port, the second two port valve flows the refrigerant from the sub-radiator first port to the inlet port when the heat energy for heating the air in the air-conditioned room by the heat exchangers is more than a sum of the heat energy cooling the outside of the air-conditioned room by the radiator and the heat energy for cooling the air in the air-conditioned room by the heat exchangers.

* * * * *